US008440898B2

(12) United States Patent
Kendler et al.

(10) Patent No.: US 8,440,898 B2
(45) Date of Patent: May 14, 2013

(54) AUTOMATIC POSITIONING OF MUSIC NOTATION

(75) Inventors: Eran Kendler, London (GB); Stefan Redtenbacher, Liphook (GB)

(73) Assignee: Knowledgerocks Limited, Hampshire (GB)

( * ) Notice: Subject to any disclaimer, the term of this patent is extended or adjusted under 35 U.S.C. 154(b) by 132 days.

(21) Appl. No.: 12/778,748

(22) Filed: May 12, 2010

(65) Prior Publication Data

US 2011/0277615 A1 Nov. 17, 2011

(51) Int. Cl.
*G10H 7/00* (2006.01)

(52) U.S. Cl.
USPC ..... 84/477 R; 84/602; 84/615; 84/634

(58) Field of Classification Search ..... 84/477 R
See application file for complete search history.

(56) References Cited

U.S. PATENT DOCUMENTS

| | | | | |
|---|---|---|---|---|
| 5,400,687 | A | 3/1995 | Ishii | |
| 6,066,791 | A | 5/2000 | Renard et al. | |
| 6,275,222 | B1 | 8/2001 | Desain | |
| 6,392,132 | B2 | 5/2002 | Uehara | |
| 6,727,418 | B2 * | 4/2004 | Matsumoto | 84/477 R |
| 6,831,220 | B2 | 12/2004 | Varme | |
| 6,838,608 | B2 * | 1/2005 | Koike | 84/477 R |
| 7,166,792 | B2 | 1/2007 | Hiratsuka et al. | |
| 7,199,299 | B2 | 4/2007 | Asakura | |
| 7,605,322 | B2 | 10/2009 | Nakamura | |
| 7,612,278 | B2 | 11/2009 | Sitrick et al. | |
| 2001/0054347 | A1 | 12/2001 | Uehara | |
| 2002/0044158 | A1 | 4/2002 | Peyser et al. | |
| 2004/0112201 | A1 * | 6/2004 | Funaki | 84/477 R |
| 2006/0048632 | A1 | 3/2006 | Morley et al. | |
| 2006/0272481 | A1 | 12/2006 | Frank | |
| 2006/0288842 | A1 * | 12/2006 | Sitrick et al. | 84/477 R |
| 2008/0092723 | A1 | 4/2008 | Sawyer-Kovelman et al. | |
| 2011/0048214 | A1 | 3/2011 | Asami | |

FOREIGN PATENT DOCUMENTS

| | | | |
|---|---|---|---|
| DE | 3839361 | A1 | 5/1990 |
| FR | 2906636 | A1 | 10/2006 |
| GB | 2334137 | A | 11/1999 |
| WO | 0150452 | A2 | 7/2001 |
| WO | 2005022509 | A1 | 3/2005 |
| WO | 2010112943 | A1 | 10/2010 |

OTHER PUBLICATIONS

XP-002660379, "Music Reader Community Documentation", 2007, http://docs.musicreader.net/Main_Page.

* cited by examiner

*Primary Examiner* — Christopher Uhlir
(74) *Attorney, Agent, or Firm* — Park, Vaughan, Fleming & Dowler, LLP

(57) ABSTRACT

A system that allows the repositioning (scrolling) of the displayed portion of a music notation computer file in rasterized format, according to an internal or external time code/metronome, to constantly display the currently active part of the music notation file. By use of a corresponding data file describing the relative position of each music stave and form defining musical markings such as repeats or codas, a software application based on this invention can shift the displayed part of the entire music file to match the current played portion of the music notation file.

15 Claims, 8 Drawing Sheets

AUTOMATIC POSITIONING OF MUSIC NOTATION

FIELD OF THE INVENTION

The present invention relates to the automated display of music notation such as sheet music, scores and lead sheet.

BACKGROUND OF THE INVENTION

Music notation in the form of sheet music, scores and lead sheet is widely available in the form of hard physical copy, whether in the form of an original print or a copy, for example in the form of a print-out of a rasterised scan. Typically, a musician places the music notation on a lectern to play the music. For all but the shortest pieces, this requires the musician or an assistant to turn the pages of the music notation as the piece progresses.

More recently, musicians have sought to make use of electronic devices to obtain and display music notation. As an example, a user of such a device seeking to learn a new instrument or a new piece may download the music notation for the piece, for example in the form of an image file in rasterised digital format, from a website specially provided for this purpose.

In this specification, the expression "rasterised digital format" means any file format that uses pixels to create an image on screen and includes file formats for bit-map images such as JPEG, TIFF, BMP and PNG file formats. Moreover, the expression "rasterised digital format" includes the PDF (Portable Document Format) file format and like formats, which can use rasterized embedded images. Like expressions shall be construed accordingly.

Having downloaded the file, the user may then print the music notation. Increasingly commonly, however, users wish to view the music notation using the electronic device. Such electronic devices include desktop, laptop, notebook and tablet computers, and even smartphones. However, such devices commonly have display screens that are too small to display the music notation full size.

Currently, when portable computers, including tablet computers are becoming the popular choice for most users, screen size limitations are more apparent, hence reading notation on such screens becomes more difficult. For example, the most popular screen size on laptop computers is currently around 13", which is smaller than an A4 sheet. It would be preferable to display a rasterised image of an A4 sheet of music on a screen size of 20" or greater.

Thus, the user has two options. First, he can reduce the scale of the image so that the whole sheet is shown. However, even on big screens the displayed notation maybe too small to comfortably be read, particularly given that the instrument may require the user to sit some distance from the display. Alternatively, he can choose to display a larger scale image, so that only a part of the sheet is displayed at one time. However, since the musician may only see a part of the entire sheet due to the limitations of computer screen size, he needs to scroll the page to reveal the hidden part and will most likely need to stop playing his instrument in order to do so.

In either case, the problem remains that music notation can span over multiple pages, hence the need to scroll interactively also remains, equivalent to turning the pages of hard copy.

STATEMENT OF INVENTION

According to a first aspect of the present invention, there is provided an electronic device adapted to display a rasterised image of music notation, the device comprising: memory that stores an image file for said rasterised image and a metadata file associated with the image file, the metadata describing the musical notation; a clock; and a processor, the electronic device being controlled to: cause a display device to display a part of the rasterised image; and change the displayed part of the rasterised image in based on the metadata and a signal from the clock.

Preferably, the metadata includes co-ordinates in the rasterised image and corresponding timing data for the beginning and end of respective staves in the music notation.

The metadata may comprise at least one of the number of bars in each of the respective staves, a time signature for the music notation, a clock rate for the clock, tags for respective instructions in the music notation, and description of a position of a musical element of the music notation relative to a constant anchor point on the image file. The musical element can be at least one of a coda, a repeat, a song start, and a song end.

Preferably, the device comprises a display screen, the number of pixels in a horizontal or vertical direction of the display screen being smaller than the number of pixels in a horizontal or vertical direction of the rasterised image.

It is preferred that the device is controlled to expand the size of the rasterised image so that a number of pixels in a horizontal or vertical direction of the display screen is smaller than the number of pixels in a horizontal or vertical direction of the expanded rasterised image.

The image file may be a container file containing a rasterised image, such as a .pdf file.

According to another aspect of the invention, there is provided an electronic device configured to display a portion of a music notation computer file in rasterised format, and to reposition the displayed part according to timing data to continuously display the currently active part of the music notation file.

According to another aspect of the invention, there is provided a method of displaying a rasterised image of music notation, the method comprising: opening an image file for said rasterised image; opening a metadata file associated with the image file, the metadata describing the musical notation; displaying a part of the rasterised image; and changing the displayed part of the rasterised image based on the metadata and a clock signal.

According to another aspect of the invention, there is provided a method for displaying a portion of a music notation computer file in rasterised format, and repositioning the displayed part according to timing data to continuously display the current active part of the music notation file.

The present invention also provides the use of structured mark-up tags to outline a text description of musical elements in a rasterised image of music notation stored as an image file, to allow a software application to sort and apply calculations in order to reposition display of the music notation computer file so that an active part of the music notation is continuously displayed.

According to another aspect of the invention, there is provided a metadata file to allow an electronic device to display a part of the rasterised image of music notation, the rasterised image being stored as an image file, and to change the displayed part of the rasterised image in accordance with a clock signal and the metadata, the metadata file comprising mark up tags describing elements of the music notation.

According to another aspect of the invention, there is provided an electronic device adapted to create a metadata file for displaying a part of the rasterised image of music notation, the rasterised image being stored as an image file, and changing the displayed part of the rasterised image in accordance with a clock signal and the metadata, the device comprising: a display; input means; a clock; and a processor, the electronic device being controlled to: provide a graphical user interface; display the rasterised image; receive an input from the user with respect to each of co-ordinates for a beginning and an end of respective staves in the music notation, the number of bars in the respective staves, a time signature for the music notation and a tempo for the music notation; based on the user input, generate structured mark up tags describing the musical notation; and associate the metadata file with the image file.

According to another aspect of the invention, there is provided a method of creating a metadata file to allow an electronic device to display a part of the rasterised image of music notation, the rasterised image being stored as an image file, and to change the displayed part of the rasterised image in accordance with a clock signal and the metadata, the method comprising: providing graphical user interface; displaying the rasterised image; receiving an input from the user with respect to each of co-ordinates for a beginning and an end of respective staves in the music notation, the number of bars in the respective staves, a time signature for the music notation and a tempo for the music notation; based on the user input, generating structured mark up tags describing the musical notation; and associating the metadata file with the image file.

According to another aspect of the invention, there is provided a computer program comprising instructions that, when carried out by an electronic device, cause the electronic device to display a rasterised image of music notation by: opening an image file for said rasterised image; opening a metadata file associated with the image file, the metadata describing the musical notation; displaying a part of the rasterised image; and changing the displayed part of the rasterised image based on the metadata and a clock signal.

According to another aspect of the invention, there is provided a computer program comprising instructions that, when carried out by an electronic device, cause the electronic device to display a portion of a music notation computer file in rasterised format, and reposition the displayed part according to timing data to continuously display the currently active part of the music notation file.

According to another aspect of the invention, there is provided a computer program comprising instructions that, when carried out by an electronic device, cause the electronic device to create a metadata file to allow display a part of the rasterised image of music notation, the rasterised image being stored as an image file, and to change the displayed part of the rasterised image in accordance with a clock signal and the metadata, by: providing graphical user interface; displaying the rasterised image; receiving an input from the user with respect to each of co-ordinates for a beginning and an end of respective staves in the music notation, the number of bars in the respective staves, a time signature for the music notation and a tempo for the music notation; based on the user input, generating structured mark up tags describing the musical notation; and associating the metadata file with the image file.

The present invention provides a data file to accompany a rasterized music notation file. The data file includes simple information about the relative position of each musical stave and essential musical form instructions (eg DS, Coda, etc) relating to a constant anchor point, such as the top left-most corner of the display window on a computer displaying the rasterized notation. In this specification, the expression stave is used to mean any line or set of lines used to express music in written format and includes the standard stave (or staff) used in standard western musical notation. The expression stave also includes any set of staves, including but not limited to two, three or more staves joined by a brace, such as the great stave (or grand staff) that are used for the piano and organ among other instruments.

Using either an internal time code or an external trigger as a means of keeping time with the music notation, the displayed music notation is scrolled when the music notation currently hidden from view is just about to be played, hence providing a fully automated music notation reader, using widely available rasterized images. Consequently, users that currently own existing music in either hard copy or rasterized images can use their existing electronic devices to usefully display the music.

BRIEF DESCRIPTION OF THE DRAWINGS

Embodiments of the present invention will now be described by way of further example only and with reference to the accompanying drawings, in which.

DETAILED DESCRIPTION

Figure 1:
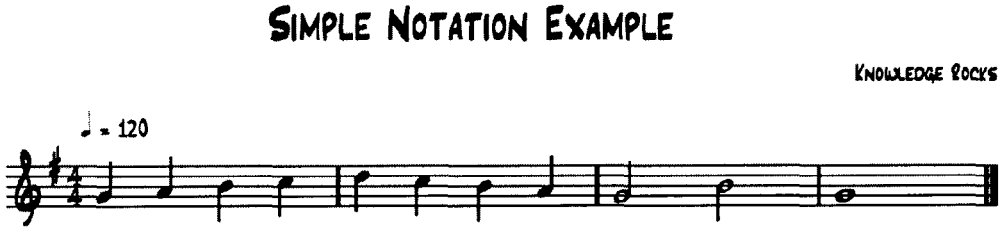
FIG. 1 is an image of a simple music notation provided in PNG file format.

The present invention provides a system to allow the repositioning (scrolling) of the displayed portion of a music notation computer file in rasterized format, according to an internal or external time code/metronome, to constantly display the currently active part of the music notation file.

In order to allow an electronic device, such as a computer or smartphone, to automatically scroll its current display window to the desired location on the music notation page, the software must know various information, which may be appended to or associated with the image file in the form of a metadata file. Preferably, the metadata file includes the following information:

1. The time signature and tempo of the music: this can also be changed many times during the performance of the musical piece by embedding the appropriate instruction in the data file.
2. The location of each one of the staves (or grand staves) in the music notation file image: this can be provided using the top left hand position and bottom right hand position of each stave. These positions do not need too be exact in order for the software to work efficiently.
3. The total width of the music page: this is useful since it may be necessary to scroll horizontally and not just vertically, but is not always essential given that the length of each stave is known.
4. Any musical form instructions widely used in music notation: for example, begin repeat bar, end repeat bar with the number of repetition, DS, Coda, 'fine', etc, together with the position data of the instructions.

In one aspect, a user can enter these points using software in combination with a graphical user interface (GUI) supporting this invention. Data entry can be very quick since none of the actual musical notes or chords needs to be entered, rather just key positions of the music notation page.

The open source standard XML is the preferred file format of the metadata file since it will allow any program in accordance with this invention to easily read and manipulate the required data. The XML format is free, and widely used in the IT world. The XML format uses a markup language with metadata tags and corresponding attributes for each tag. However, the skilled addressee will recognise that other file formats are suitable for use in the present invention.

It is preferred that in the present invention positions are described as co-ordinates using two integer numbers separated by a comma, which represent the position of the event on the specified page in 100% magnification from one possible anchor point—preferably the top left hand corner of that page. The top left hand corner, which will be referred to as TLHC, is hence considered 0,0. The first number is the horizontal position in pixels to the right of the TLHC, whereas the second number is the vertical position in pixels down from the TLHC. Thus, the co-ordinates 40,120 represent a position 40 pixels left and 120 pixels down from the TLHC.

It will be appreciated that two or more sheets of music may be shown in a single rasterised image file, for example where a copier is used to scan two facing pages in a music book at the same time and saves the result as a PDF file. The present invention can handle this eventuality in a number of possible ways, including designating two or more TLHCs to the image and treating the image as having two or more separate pages; otherwise partitioning the pages; or more preferably treating the image as a single page and using the co-ordinates of all the staves in the image and the order of those staves to decide which portion of the image to display at any given time. It will be appreciated by those skilled in the art that other methods of handling this eventuality are possible.

Figure 7:
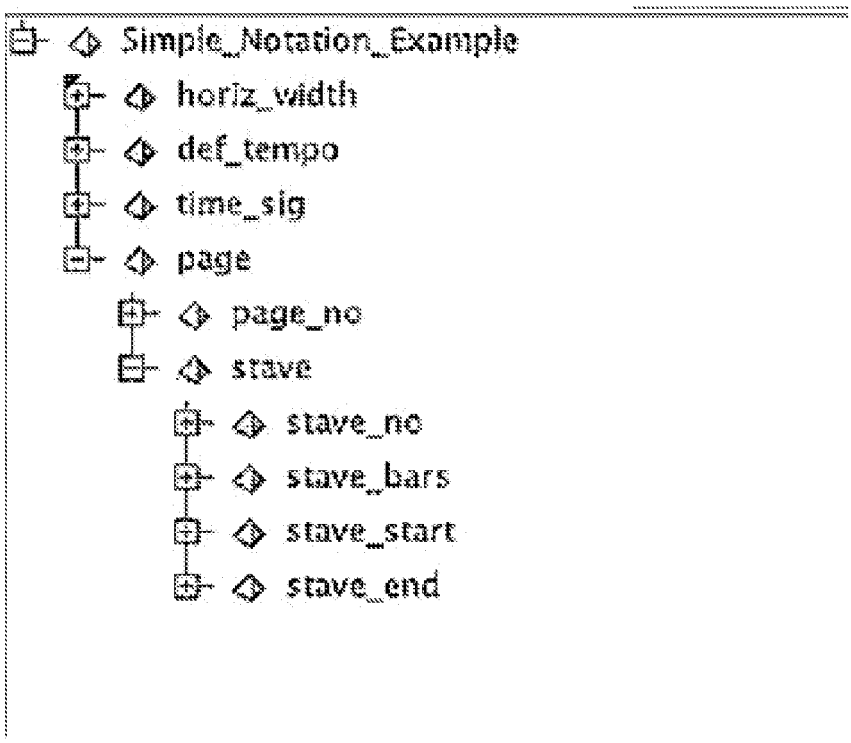
FIG. 7 illustrates an exemplary structure of a simple metadata file in accordance with some embodiments described herein.

FIG. 7 illustrates an exemplary structure of a simple metadata file in accordance with some embodiments described herein.

Data about the rasterised image file is provided using tags shown in FIG. 7. The tags in FIG. 7 are explained as follows:

| | |
|---|---|
| <file_name> | in this example, the file name is "Simple_Notation_Example". |
| <horiz_width> | the horizontal width of the image in pixels. This simply tells the software application the overall width of the music notation file. Since the software knows the overall available screen space of the device on which it is running, it can calculate what the currently visible portion of the music notation is. |
| <def_tempo> | default tempo. This allows the software application to set the basic tempo at which the music will be scrolled. |
| <time_sig> | time signature. This is a music notation standard definition that tells the reader how many beats are in each musical bar. |
| <page> | This tag marks that all following tags, until the next <page> tag will belong to the described page. |
| <page_no> | page number |
| <stave> | This tag and all enclosed tags describe information about the particular stave |
| <stave_no> | stave number |
| <stave_bars> | the number of bars in the stave |
| <stave_start> | the position of the start of the stave, provided as the pixel co-ordinates of the TLHC of the stave |
| <stave_end> | the position of the end of the stave, provided as the pixel co-ordinates of the bottom right hand corner (hereafter BRHC) of the stave |

The application of this metadata file structure can be illustrated using a simple example. FIG. 1 is a rasterised image from a simple music notation file in PNG format, which includes a single stave of music notation spanning 4 bars.

While this simple example can be displayed in its entirety on most bigger computer screens, on some smaller laptops, tablet PCs and smartphones, only a portion of the horizontal information will be displayed with great enough magnification to allow comfortable reading, hence the need to 'scroll' the file horizontally when bar 3 or 4 is reached.

Using the simple metadata file structure discussed above, the XML metadata file for the music notation shown in FIG. 1 is

```
<Simple__Notation__Example>
<horiz__width>1914</horiz__width>
<def__tempo>120</def__tempo>
<time__sig>4/4</time__sig>
<page>
<page__no>1</page__no>
<stave>
<stave__no>1</stave__no>
<stave__bars>4</stave__bars>
<stave__start>20,315</stave__start>
<stave__end>1900,395</stave__end>
</stave>
</page>
</Simple__Notation__Example>
```

The tags in this example can be explained as follows:

| | |
|---|---|
| <horiz_width> | In the example file, the horizontal width is 1950 pixels. |
| <def_tempo> | The default tempo is 120 BPM (beats per minute) |
| <time_sig> | In the example, each bar holds 4 beats or ¼ notes (crochets). In FIG. 1, since there are 4 bars of music, there are 16 total beats for the duration of the entire music, spanning over one line. |
| <page> | Since the example is only one page, this tag has less weight, but it is provided for the structural integrity of the format |

There is only a single <stave>tag, meaning that there is only one stave. The stave includes 4 bars, with the TLHC at co-ordinates 20,315 and the BRHC co-ordinates at 1900,395.

Using the provided data, the space occupied by each musical beat can be calculated, for example:

Stave total length: 1900−20=1880 pixels

Total beats in the stave: 4 beats per bar×4 bars=16

Each beat will occupy 1880/16=117.5 pixels

The metadata file can be used by an electronic device according to the present invention to display music notation such that the portion of the music notation being displayed at any one time corresponds with the portion of music that is being played, or that should be played by a musician.

Thus, in the current example, if the screen used to display the notation can only show 1100 pixels of the total 1950 file width, only about 9 beats, or 2 bars and 1 beat, will be displayed. The remaining parts of the music notation will be hidden (not displayed). In order to constantly display the current played portion of music notation in FIG. 1, it is necessary to shift (or scroll) the display to show the hidden part of the notation before the tenth beat is reached.

Accordingly, in the present invention a metronome provided by the electronic device is activated by the user, or by another input. The timing of the metronome is determined by the tempo of the music, in this case 120 BPM. At the same time, the electronic device displays the first portion of the music notation, up to the 9th beat. Once the metronome has counted, for example, four beats or one bar, it shifts or scrolls the image rightwards so that the first four beats (first bar) are no longer displayed and instead the next 9 beats are displayed—that is beats 5 to 14. Again, once the metronome has counted another four beats, it shifts or scrolls the image rightwards so that the first eight beats (first and second bars) are no longer displayed and instead only the last eight beats (two bars) are displayed.

The positions of the beginning and end of bars and/or beats in the display can be calculated, as described above, based on the number of bars and/or beats in the stave and the TLHC and BRHC co-ordinates of the stave. The calculation also takes into account the size of the display screen available for displaying the image, the size of the image at 100% magnification and whether the image is to be zoomed in or out. Preferably the user is enabled to set the degree of magnification and the co-ordinate positions in the metadata file (which are for an image at 100% magnification) are multiplied by the zoom factor.

Consequently, by appending or associating a small metadata file to or with a rasterised image file, it is possible to achieve the functionality of displaying only the active part of musical notation at a scale large enough to be comfortably read by a musician. By "active part" is meant that part of the musical notation that his currently being played, or the part that should be played by a musician.

Advantageously, the metadata file can be provided as a text file, for example in XML format and has a very small footprint with respect to the image file.

It will be appreciated that the foregoing provides only a simple illustrative example of the concept underlying the present invention. Although the tags described above are sufficient to describe a simple example, further tags may be provided for more complex musical notation. Such tags include but are not limited to:

| | |
|---|---|
| <song_start> | used to represent the DC instruction in music |
| <repeat> | outlines a section of bars that will be repeated, with the following enclosed tags |
| <repeat_start> | the position of the beginning of the first bar to be repeated |
| <repeat_end> | the position of the end of the ending repeat bar |
| <repeat_alt_end> | alternative ending bar: the position of different, specific endings eg first ending, second ending and so forth |
| <repeat_times> | how many times the repeat takes place |
| <sign> | the position of the segno mark ('segno' is Italian for 'sign'); multiple segno marks can be specified |
| <ds> | once this position is reached, go to the <sign> tag ('Dal Segno' is Italian for 'go to the sign'), |
| <dc> | once this position is reached, go to the <song_start> tag ('Dal Capo' is Italian for 'go to the head' or go to the beginning of the piece) |

For both <dc> and <ds> tags, the <al_coda> tag can be specified, indicating to go to the corresponding coda, on the second time this tag is reached.

| | |
|---|---|
| <coda> | the position of the coda mark. Multiple coda marks can be specified ('coda' is Italian for 'tail'—normally the end of the piece), |
| <coda_no> | the serial number of the coda, to allow multiple coda signs |
| <coda_goto> | go to coda tag |
| <fine> | song end ('fine' is Italian for 'end') |
| <time_sig> | time signature change which will determine the amount of basic musical beats per bar |

For all tags, the_pos suffix can be added to describe the position of notation in the image.

It is noted that repeats and other elements may have a start point on one page of music and an end point on another. This can be handled in at least two different ways. The first is to use a three part position marker for repeat start/end with the page no included, for example:

```
<repeat>
    <repeat__no>1</repeat__no>
    <repeat__times>2</repeat__times>
    <repeat__start>p1,96,130</repeat__start>
    <repeat__end>p2,530,127</repeat__end>
        </repeat>
```

The second is to provide an entirely separate meta tag for the start and end of the repeat respectively, for example:

```
<repeat__start>
    <repeat__no>1</repeat__no>
    <pos>96,130</pos>
        </repeat__start>
<repeat__end>
    <repeat__no>1</repeat__no>
    <repeat__times>1</repeat__>
    <pos>530,127</pos>
        </ repeat__end>
```

Each of the start and end tags internally includes the repeat number. This way if a repeat starts on page 1 and ends on page 2, the <repeat_start> will be in the metadata for page 1, and the <repeat_end> will be in the metadata for page 2. The software is able to use the repeat number in each of the tags to match them up. Of course, using this option the start and end of a repeat may be on the same page too. The advantage of this option is that, when entering the start of the repeat, the user does not need to find the end of the repeat immediately, which may be on a different page, to complete data entry for that repeat and moving on to the next element. This simplifies the data entry process for the user.

Thus, it will be appreciated that the use of tags allows any notation file to be accurately described so that the active part of the music notation can be visible at any time. It will further be appreciated that the tags described above may be varied according to users' specific needs, and other tags are available.

In one aspect, the present invention provides an electronic device arranged to display rasterised images of music notation using the methodology described above. Such an electronic device may be any form of computer, including a desk top, laptop, tablet or other portable computer, and also including a smartphone, PDA or other portable communications device.

Figure 4:
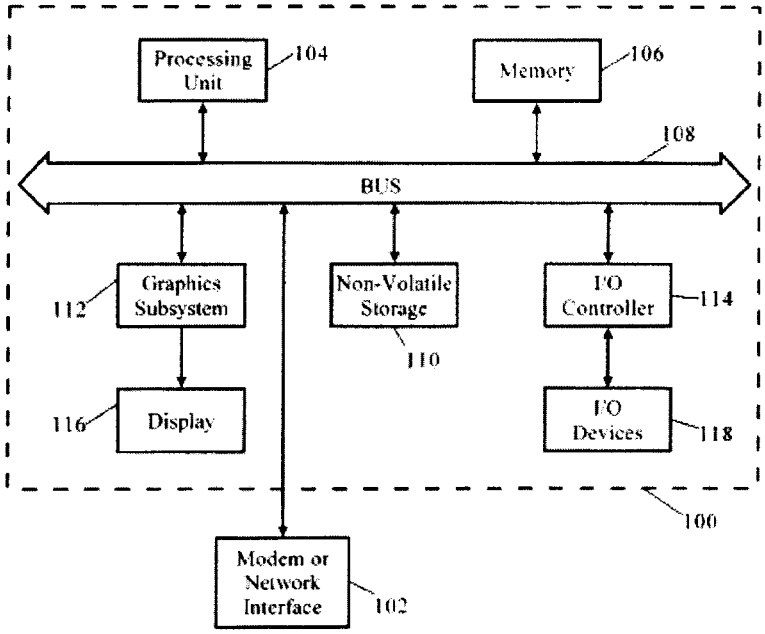
FIG. 4 is a block diagram illustrating the constitution of the electronics of an electronic device according to the present invention.

FIG. 4 illustrates an exemplary embodiment of a computer system 100 that may be used to display the music notation image in accordance with the present invention. As noted above, computer system 100 may form part of a desktop computer or a laptop computer, or any computer device.

The computer system 100 may but need not interface to external systems through a modem or network interface 102, such as an analogue modem, ISDN modem, cable modem, token ring interface, or satellite transmission interface. Thus, the user may be able to receive an image file for a rasterised image of music notation from an on-line store, by e-mail or by other electronic means. As shown in FIG. 4, the computer system 100 includes a processing unit 104, which may be a conventional microprocessor, such as an Intel Core Duo microprocessor, or another microprocessor, which are known to one of ordinary skill in the computer art. System memory 106 is coupled to the processing unit 104 by a system bus 108. System memory 106 may be a DRAM, RAM, static RAM (SRAM) or any combination thereof. Bus 108 couples processing unit 104 to system memory 106, to non-volatile storage 110, to graphics subsystem 112 and to input/output (I/O) controller 114.

The I/O devices 118 in the preferred embodiment include one or more of a speaker, a display device, a keyboard, a disk drive, a mouse and the like as known to one of ordinary skill in the computer art.

Some or all of the control software will normally be stored on the non-volatile storage 110, which may be a hard drive. However, some or all of the control software may also be stored on an externally connectable storage medium, such as a flashcard, a USB memory stick or a CD. These devices would then constitute part of the I/O devices shown as item 118 in FIG. 4.

Naturally, the various components of the electronic device may be distributed. For example, the display device and the microprocessor may be remote from one another.

Preferably, the electronic device will run appropriate software embodying a routine or instructions according to the present invention. However, such a routine or instructions can also be manifested entirely or partly in hardware.

Figure 5:
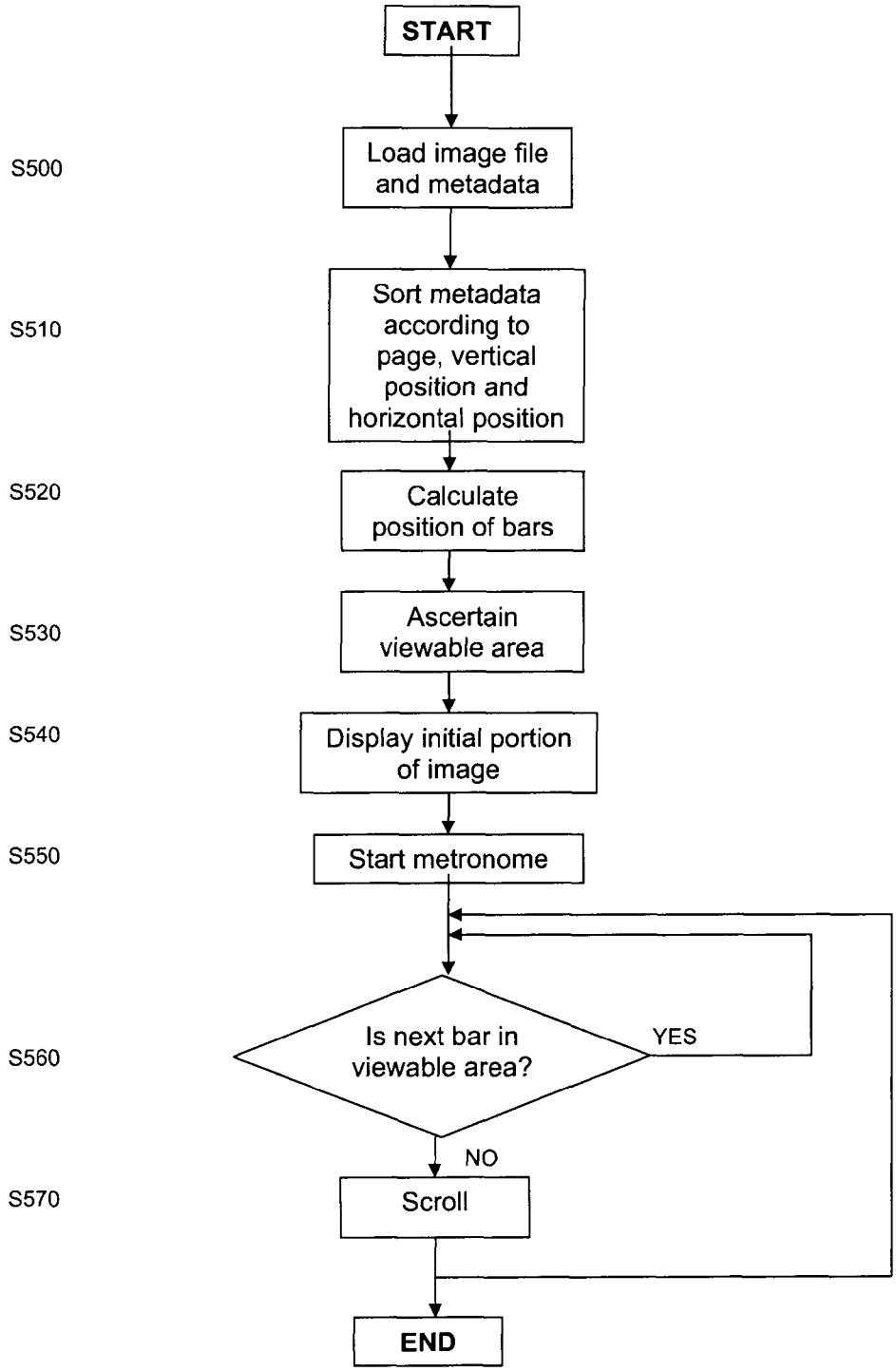
FIG. 5 is a flowchart showing the display of a rasterised image.

In the preferred embodiment, a software application will cause the electronic device to upload the rasterised image file together with the associated or appended metadata file (step S500 in FIG. 5). The device will then sort the metadata entries for each page according to vertical position and then according to horizontal position (step S510). As noted above, a single rasterised image may include more than two "pages" of music—that is, a first set of staves on the left hand side of the image, which are read from top to bottom before a second set of staves on the right hand side of the image is read from top to bottom—and the device will sort the metadata entries accordingly.

Each position is also recalculated according to the current zoom ratio set by the user. For example, if the user magnifies the score by 2×, the co-ordinates of each position are multiplied 2×.

In the preferred embodiment, the application assumes that each stave allows equal horizontal space for each bar. Hence, the application can calculate the position of each bar, without metadata for individual bars needing to be provided (step S520). Further to that, staves can be omitted from the metadata if a user is willing to accept reduced accuracy. This has the benefit that data entry—that is, metadata file creating or editing—can be done faster.

Preferably on receipt of an instruction from a user or another external instruction, the software application starts an internal metronome (step S550) and brings the beginning of the music notation in the image into view on the display screen (step S540). The internal metronome can simply be provided by operating on a clock signal provided by the clock 101 in accordance with tempo data provided in the metadata file. Since the software application can obtain the total width of the rasterised image or PDF, and can ascertain the viewable area (step S530) of the current window in which the image is being displayed, it can now calculate if the next bar played is within the user's viewable area (step S560). If it is not, it simply shifts (or scrolls) the image in the window, so the next position is in view in the manner discussed above (step S570) until all the music has been displayed.

It will be appreciated that there are a number of ways in which the image can be scrolled, including a bar at a time, or half (or another proportion of) a stave at a time, or a predetermined number of beats at a time (including one beat at a time). The image can also be scrolled smoothly. The rate of scrolling will depend on the size of the image, the zoom factor and the size of the display screen available to display the image (for example full screen or window). In the preferred embodiment, the user is able to control the size of the scrolling step, including whether to scroll smoothly, using the GUI provided by the device.

Moreover, since the software application is able to determine the end point of one stave and the start point of another, the software can control the electronic device to display the end of one stave and the beginning of the next stave next to one another at the same time. In this manner, all staves can effectively be shown in a single continuous line. Thus, not only need the user not turn pages, he need not even move his eyes to jump vertically from stave to stave.

The present invention also provides that the same electronic device or another electronic device can be used to input the metadata for the rasterised image and create the metadata file. The electronic device used for this purpose may have the same general architecture as that described in FIG. 4 and may be any suitable device, including a desktop, portable, tablet or other computer and a smartphone.

Figure 6:
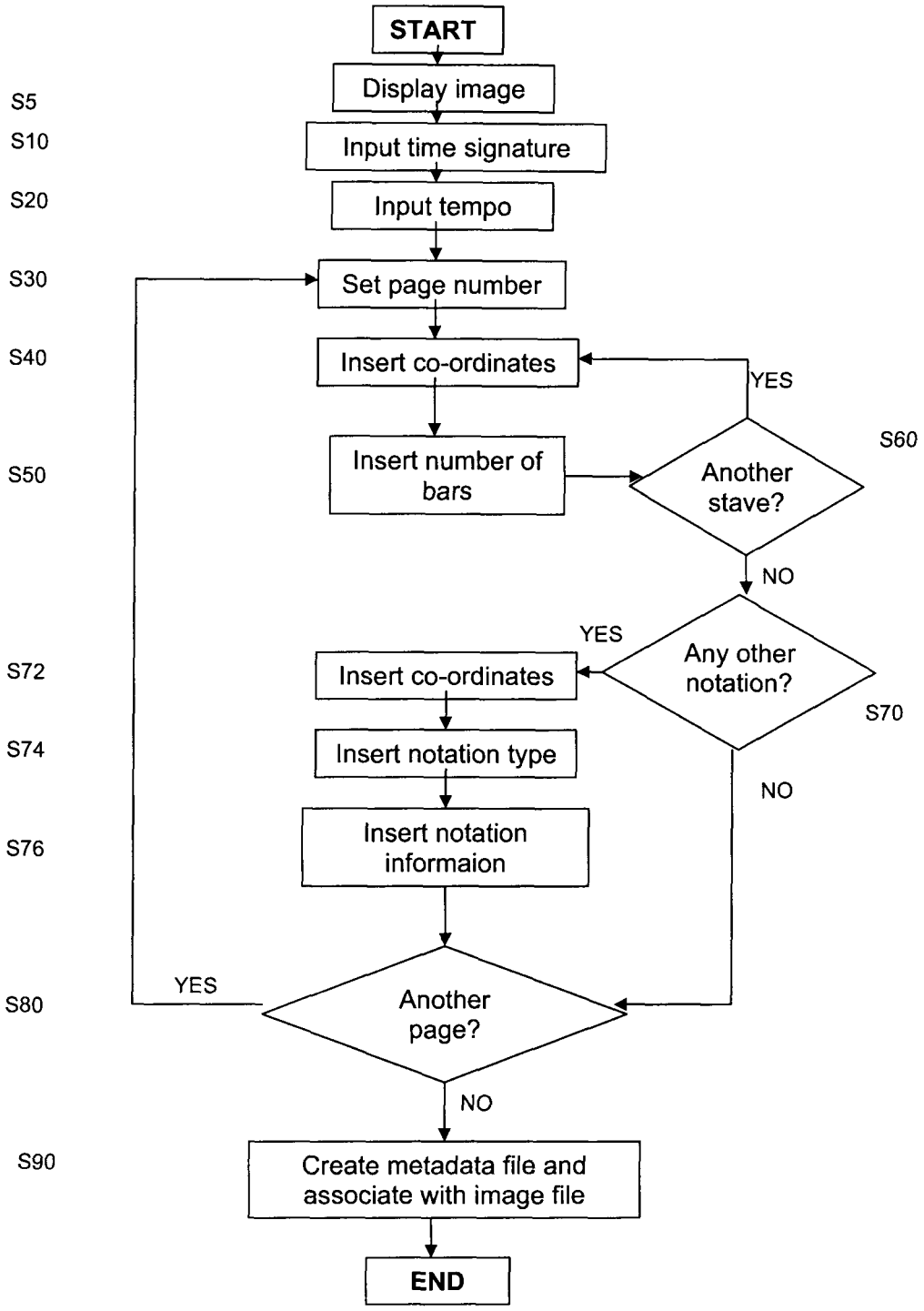
FIG. 6 is a flowchart showing the creation of a metadata file.

To input the data, the display device displays the rasterised image of the music notation and invites the user to enter the time signature of the music and the tempo at which it should be played (steps S10 and S20 in FIG. 6). The user is then requested to identify the co-ordinates of each of the staves on the page and, for each of the staves, the user is requested to enter the number of bars (steps S40 and S50). In the preferred embodiment, the user inputs the co-ordinates of each stave by placing a cursor at the TLHC corner of the stave, clicking and holding down the mouse button, dragging the cursor to the BRHC of the stave to cause the electronic device to draw a box around the stave, and releasing the mouse button, as shown in FIG. 3, in which a user has placed a box around the first stave in FIG. 2A. The electronic device can then extract the beginning and end of the stave as well as the vertical extent of the stave that needs to be shown during subsequent display.

Once all the staves on a page have been input (step S60), the user is asked whether there is any other musical notation element on the page (step S70) and, if so, to insert the type of element (step S72) and the co-ordinates (step S74). The user can input the co-ordinates by moving the cursor to the position of the element and clicking on it to input its co-ordinates. The type of element can be input by using a drop down menu or by allowing a user to click on an icon or button matching the element. The response to the request for information on the type of element will trigger appropriate requests for further information about the element (if any) (step S76). For example, if the element is a repeat instruction, the user will be asked to input the repeat start, the repeat end and the number of repeats. Here, it should be noted that co-ordinates of elements may include not only the position of the element with respect to a predetermined point on the page, but also the page number on which the element is to be found. This allows, for example, repeat starts and ends to be on different pages.

Once data for all the elements have been input (step S70), the user is asked whether there is another page (step S80) and, if there is, the process starts again (step S30). If not, the device creates the metadata file and associates it with the image file.

It should be recognised that although the foregoing has been described with respect to the use of a mouse and display screen as the GUI, other GUIs such as a touchscreen can also be used.

Accordingly, the present invention has the significant benefit that at least the currently active part of a rasterised image of music notation—that is, the part that is currently being played or should be played by a musician—can always be displayed. Moreover, the currently active part can be displayed with a degree of magnification such that it can be comfortably be read by a user, even of electronic devices with smaller screens such as tablet computers and mobile phones. The only input required of the user during playback is to start the playback. Subsequently, all staves in the music are displayed one after the other, with a significantly reduced need for the user to move his eyes and no need for the user to turn pages of music.

In addition, the user is able to create the metadata file for even long, complicated pieces of music extremely quickly. Thus, a user can scan in sheet music to create a rasterised image, or buy a rasterised image on-line, and quickly create a metadata file. Thus, the user is able to display music notation on screen and control the display according to tempo, without having to compose the music using a proprietary application or to use a proprietary notation application to transcribe the music note by note, which is a time-consuming and laborious process.

Moreover, since the music can be displayed stave by stave and bar by bar, there is no need to turn pages by hand, or to use a hand or footswitch to change the electronic display of pages of music.

Also, since the software using the metadata file can take into consideration any screen size and any magnification, the solution provided by the present invention can be used in any computer-based solution, including portable devices like phones and tablet PCs.

Figure 2A:
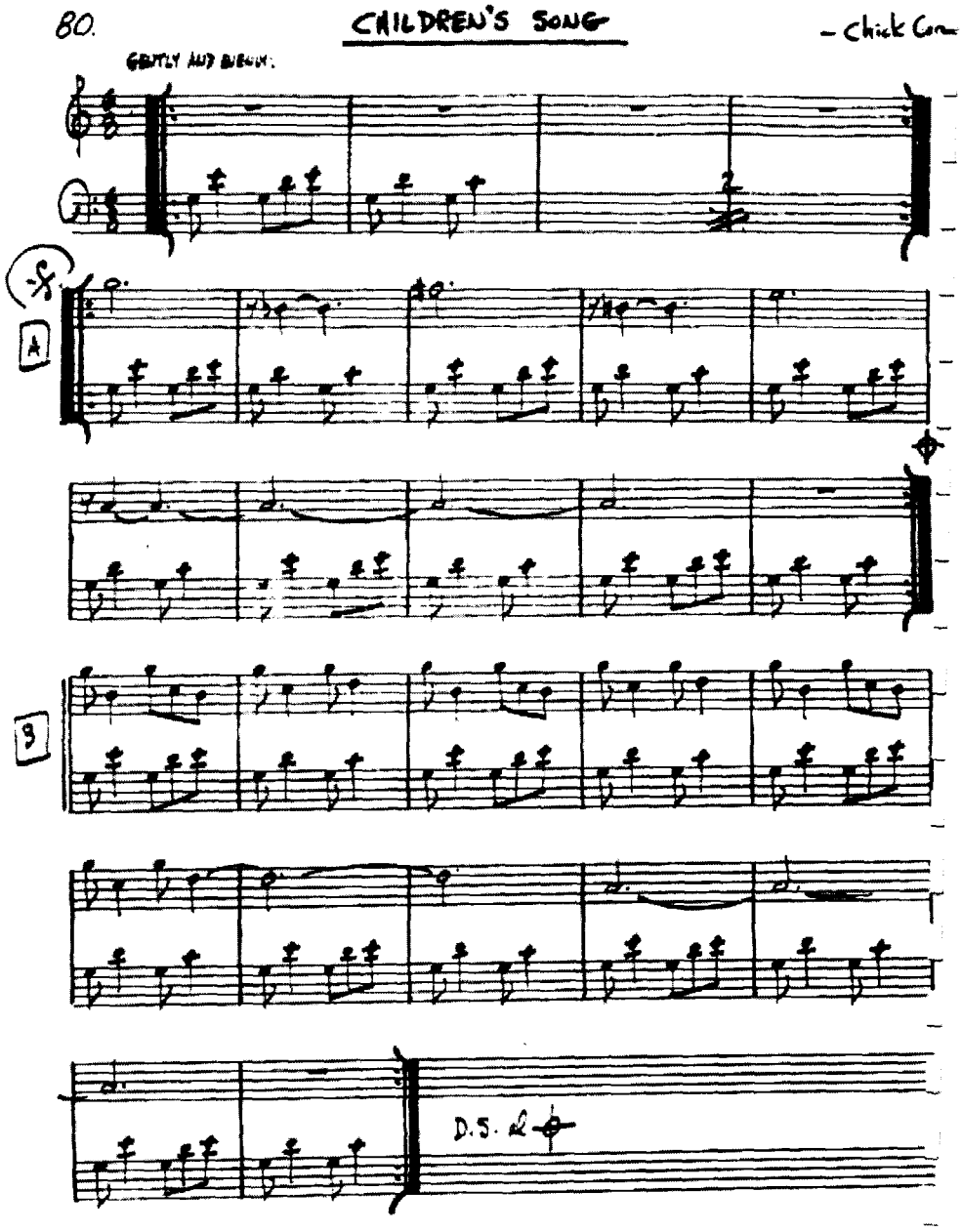
FIGS. 2A and 2B show images of a more complicated music notation spanning two pages and provided in PDF file format.
Figure 2B:
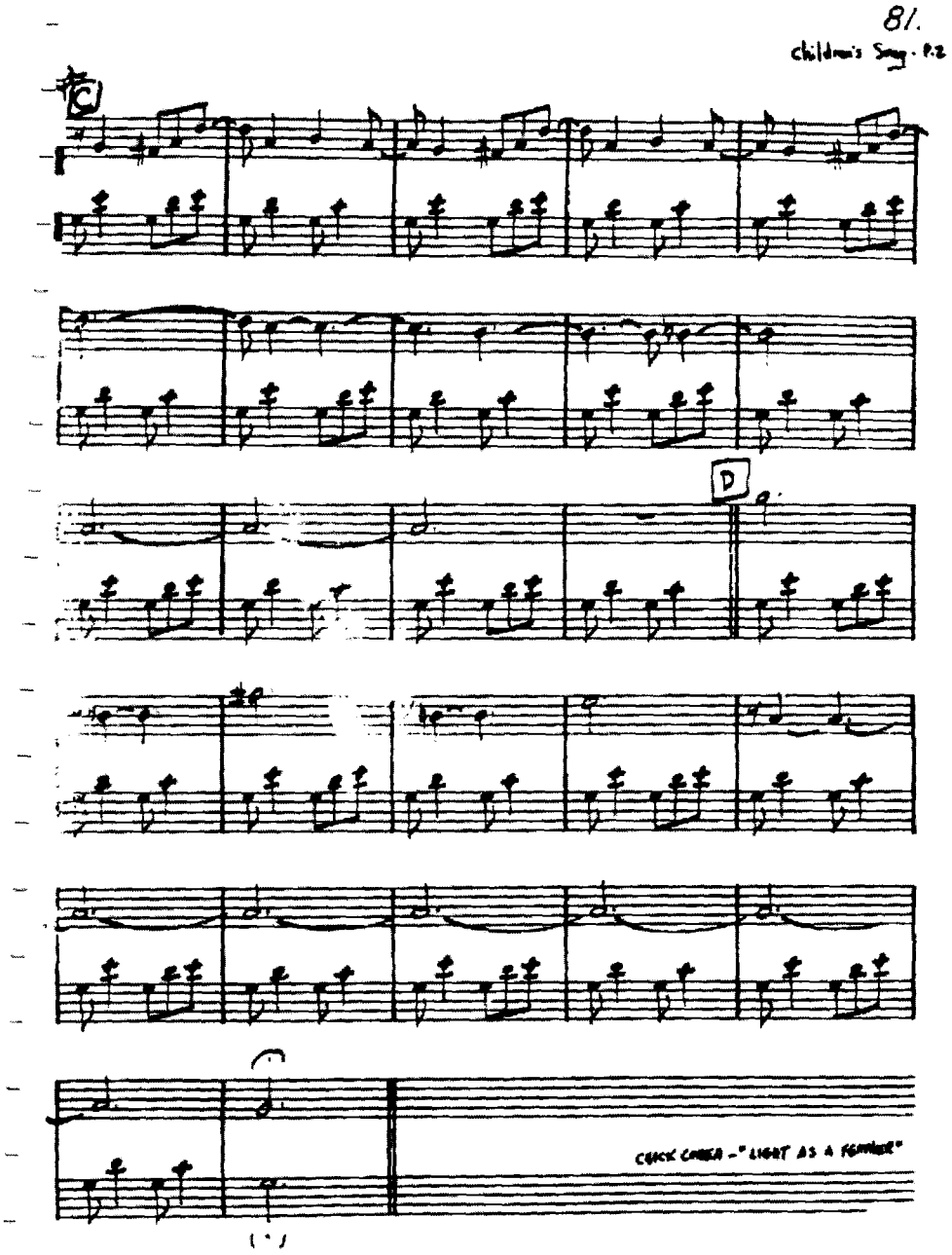
Figure 3:
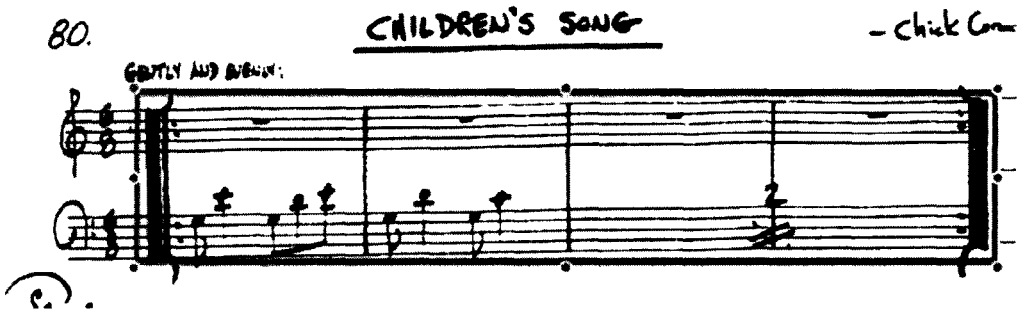
FIG. 3 shows the first great stave of the music notation in FIG. 2A for the purposes of illustration.

A further, more complicated example of a rasterised image of musical notation is shown in FIGS. 2A and 2B, which show images of respective pages of sheet music, the images being stored in a single .pdf file. A single metadata file in XML format produced for the two images may be:

```
<notation_file>
<file_name>
    children_song_leadsheet.pdf
  <def_tempo>120</def_tempo>
  <time_sig>4/4</time_sig>
  <page>
    <page_no>1</page_no>
      <stave>
        <stave_no>1</stave_no>
        <stave_bars>4</stave_bars>
        <stave_start>97,124</stave_start>
        <stave_end>550,310</stave_end>
          </stave>
      <stave>
        <stave_no>2</stave_no>
        <stave_bars>5</stave_bars>
        <stave_start>56,236</stave_start>
        <stave_end>553,315</stave_end>
          </stave>
      <stave>
        <stave_no>3</stave_no>
        <stave_bars>5</stave_bars>
        <stave_start>56,348</stave_start>
        <stave_end>554,427</stave_end>
          </stave>
```

-continued

```
      <stave>
        <stave_no>4</stave_no>
        <stave_bars>5</stave_bars>
        <stave_start>58,455</stave_start>
        <stave_end>559,533</stave_end>
          </stave>
      <stave>
        <stave_no>5</stave_no>
        <stave_bars>5</stave_bars>
        <stave_start>62,568</stave_start>
        <stave_end>560,653</stave_end>
          </stave>
      <stave>
        <stave_no>6</stave_no>
        <stave_bars>2</stave_bars>
        <stave_start>62,680</stave_start>
        <stave_end>266,740</stave_end>
          </stave>
      <repeat_start>
        <repeat_no>1</repeat_no>
        <repeat_pos>96,130</repeat_pos>
          </repeat_start>
      <repeat_end>
        <repeat_no>1</repeat_no>
        <repeat_times>2</repeat_times>
        <repeat_pos>530,127</repeat_pos>
          </repeat_end>
      <repeat_start>
        <repeat_no>2</repeat_no>
        <repeat_pos>60,280</repeat_pos>
          </repeat_start>
      <repeat_end>
        <repeat_no>2</repeat_no>
        <repeat_times>2</repeat_times>
        <repeat_pos>540,377</repeat_pos>
          </repeat_end>
      <repeat_start>
        <repeat_no>3</repeat_no>
        <repeat_pos>60,280</repeat_pos>
          </repeat_start>
      <repeat_end>
        <repeat_no>3</repeat_no>
        <repeat_times>2</repeat_times>
        <repeat_pos>256,711</repeat_pos>
          </repeat_end>
      <coda>
        <coda_no>1</coda_no>
        <coda_goto>538,342</coda_goto>
          </coda>
      <segno>
        <segno_no>1</segno_no>
        <segno_pos>52,240</segno_pos>
          </segno>
      <ds>
        <ds_no>1</ds_no>
        <ds_pos>52,240</ds_pos>
        <al_coda>1</al_coda>
          </ds>
          </page>
<page>
  <page_no>2</page_no>
      <stave>
        <stave_no>1</stave_no>
        <stave_bars>5</stave_bars>
        <stave_start>30,137</stave_start>
        <stave_end>530,207</stave_end>
          </stave>
      <stave>
        <stave_no>2</stave_no>
        <stave_bars>5</stave_bars>
        <stave_start>32,246</stave_start>
        <stave_end>525,224</stave_end>
          </stave>
      <stave>
        <stave_no>3</stave_no>
        <stave_bars>5</stave_bars>
        <stave_start>40,353</stave_start>
        <stave_end>540,426</stave_end>
          </stave>
```

-continued

```
<stave>
    <stave_no>4</stave_no>
    <stave_bars>5</stave_bars>
    <stave_start>40,466</stave_start>
    <stave_end>538,426</stave_end>
        </stave>
<stave>
    <stave_no>5</stave_no>
    <stave_bars>5</stave_bars>
    <stave_start>42,578</stave_start>
    <stave_end>541,633</stave_end>
        </stave>
<stave>
    <stave_no>6</stave_no>
    <stave_bars>2</stave_bars>
    <stave_start>49,684</stave_start>
    <stave_end>244,762</stave_end>
        </stave>
<fine>
    <fine_pos>244,762</fine_pos>
        </fine>
        </page>
        </file_name>
        </notation_file>
```

Thus, it can be seen that the metadata file describes that there are two pages of music in 4/4 time to be played at a tempo of 120 bpm. Each image/page is described as having six staves/grand staves. The metadata file indicates that there are three repeat elements—the first starts at the beginning of the first stave and ends at the end of the first stave, with the effect that this stave is played twice; the second starts at the beginning of the second stave and ends at the end of the third stave, with the effect that these two staves are played twice; and the third starts at the beginning of the second stave and ends at the end of the sixth stave, with the effect that these four stave are played twice. There are also ds, segno and coda notation elements on the first page. Finally, the metadata file indicates that the end of the music is on the second page at pixel co-ordinates 244, 762 from the TLHC of the image.

The rasterised image includes rehearsal marks C and D on page 2. However, when creating the metadata file, the user decided not to include them. Although not discussed above, it should be noted that separate metatags can be created for rehearsal marks. Usually, rehearsal marks are used by conductors to quickly bring the attention of the orchestra/band members to a specific part of the score. The present invention may provide the user with the option to begin display of the score at a predetermined rehearsal mark (or another tagged element) instead of the beginning of the score, or to loop between rehearsal marks (or other tagged elements). This is indicative of the versatility and control that the present invention offers users.

Once the user initiates playback, the electronic device displays the start of the image on page 1, starts the metronome and scrolls through the staves as the music is played. In particular, once the last bar or beat of the first page has been displayed and just before the beginning of the first stave on the second page needs to be played, it is displayed. Preferably, the end of one page and the beginning of the next page are displayed simultaneously next to each other.

According to a further aspect of the invention, the display of a rasterised image of music notation can be synched to any audio or video file.

SMPTE (Society of Motion Picture and Television Engineers) code is a standard code used in both audio and video files to mark events in time. Since SMPTE code is constant and relates to time, it will be interpreted identically by all computer systems regardless of make or operating system.

A metadata file as described above, but including at least the start time of the audio/video that corresponds to the music notation file and the end time that corresponds to the end of the music notation file, is used.

For example, an audio file in AIFF format may include the musical execution of the notation in FIG. 1—in other words, the sound of the music in FIG. 1 being played. In this example, the audio doesn't start exactly at the beginning of the file, rather at 00:00:02:12 (meaning 2 seconds and 12 frames after the beginning of the audio file). The ending is at 00:00:10:12. This information is included in the metadata file.

The total length of the audio is hence 00:00:10:12−00:00:02:12=00:00:8:00 seconds. Considering that this duration is for 16 beats, the internal metronome of software based on this invention needs to create a beat every 0.50 seconds corresponding to 120 BPM.

In order to play the audio and display the music notation, the electronic device loads up each of the audio file, the rasterised image file and the metadata file. On starting to play the audio file, the electronic device displays the beginning portion of the music notation depending on the size of the display available, the size of the image and the selected magnification. Once the start time of the music is reached in the audio file, the electronic device starts the metronome at the specified tempo and changes the display of the music notation in accordance with the metadata. Changing the display of the music notation is timed to end with playing the audio file.

Those skilled in the art will recognise that using the present invention display of music notation can also be easily and quickly synchronised to playing of video files either alone or together with audio files, or to containers for both formats, such as MPEG.

In this way, the present invention allows a user to see a video of music being played and/or hear the music being played at the same time as easily viewing the notes. The present invention is also useful for laying down additional tracks onto a partially completed performance in a recording studio, for example for a singer to add vocals to an instrumental piece. Consequently, the present invention provides a valuable teaching aid, as well as a music making aid and an entertainment aid.

An example has been given in which two rasterised images are stored in a container file of .pdf format. It has also been explained that the present invention can handle the inclusion of more than two pages of music in a single rasterised image. However, it will be appreciated by those skilled in the art that the present invention is also applicable for displaying music notation for a single piece stored in multiple rasterised image files, for example multiple .tif files. In this case, when creating the metadata file, for each page of music the electronic device can record as metadata the file name of the image file in which the page is stored, together with the order in which the staves/pages/image files appear in the music. Thus, the present invention may provide a single metadata file for a plurality of image files. Alternatively, a metadata file may be provided for each image file and either the image files or the metadata files may be linked to allow display of the music notation in the correct order.

It will be appreciated that the present invention may allow a user to update an existing metadata file, for example by replaying each of the steps that were originally undertaken when creating the metadata file and allowing the user to write over, delete or add to any one or more of the steps. Thus, it would be a simple matter to allow a user to redraw a box for a stave, to correct the number of bars in the stave, or to add a new musical element, for example.

It is further preferred that the user may change the tempo of the music either by changing the tempo tag in the metadata or by using a control in the playback module specially provided for this purpose, without changing the metadata. The user may also be enabled to fast forward and rewind through display of the music notation.

In the foregoing, it has been described that the metronome is started either by the user or by the SMPTE flagged start time in an audio/video file. However, the metronome and changing the display of the music notation may also be started externally, and the metronome may be externally provided. For example, if several people are playing in a band or other group of musicians, one of the musicians or a third party such as a conductor may start the metronome to control display of all of the musicians' individual electronic devices for displaying the music notation.

The foregoing description has been given by way of example only and it will be appreciated by a person skilled in the art that modifications can be made without departing from the spirit and scope of the present invention.

The invention claimed is:

1. An electronic device adapted to display a rasterised image of musical notation, the device comprising:

memory that stores an image file for said rasterised image and a metadata file associated with the image file, the metadata describing the musical notation and including a time signature and a tempo;

a clock; and a processor, the electronic device being controlled to:

sort the metadata according to page, a vertical position in the musical notation and a horizontal position in the musical notation;

calculate a position of bars in the musical notation based on the time signature and the tempo;

ascertain a viewable area of a display device, on which the rasterised image is to be displayed;

from the calculated bar positions, ascertain a number of said bars, which can fit into said viewable area, and displaying said number of bars;

operate said clock in accordance with said tempo;

determine that said clock has reached an end of the displayed number of bars; and change a displayed part of the rasterised image;

wherein the metadata include co-ordinates in the rasterised image and corresponding timing data for a beginning and an end of respective staves in the musical notation, and a number of bars in the respective staves;

the electronic device being controlled to calculate said bar positions by:

ascertaining a total length of the respective staves in pixels;

ascertaining from the time signature and the number of bars in the respective staves a number of beats in the respective staves and, from the total length of the respective staves and the number of beats in the respective staves, calculating a width in pixels of each of said beats in the respective staves; and ascertaining the bar positions in the respective staves from the widths of said beats.

2. An electronic device according to claim 1, the metadata comprising a clock rate for the clock.

3. An electronic device according to claim 1, the metadata comprising tags for respective instructions in the musical notation.

4. An electronic device according to claim 1, the metadata comprising a description of a position of a musical element of the musical notation relative to a constant anchor point on the image file.

5. An electronic device according to claim 4, the musical element being at least one of a coda, a repeat, a song start, and a song end.

6. An electronic device according to claim 1, the display device comprising a display screen, a number of pixels in a horizontal or vertical direction of the display screen being smaller than a number of pixels in a horizontal or vertical direction of the rasterised image.

7. An electronic device according to claim 1, the display device being controlled to expand a size of the rasterised image so that a number of pixels in a horizontal or vertical direction of the display screen is smaller than a number of pixels in a horizontal or vertical direction of the expanded rasterised image.

8. An electronic device according to claim 1, the image file being a container file containing a rasterised image.

9. An electronic device according to claim 1, the image file being a .pdf file.

10. A method of displaying a rasterised image of musical notation, the method comprising:

opening an image file for said rasterised image;

opening a metadata file associated with the image file, the metadata describing the musical notation and including a time signature and a tempo;

sorting the metadata according to page, a vertical position in the musical notation and a horizontal position in the musical notation;

calculating a position of bars in the musical notation based on the time signature and the tempo;

ascertaining a viewable area of a display device, on which the rasterised image is to be displayed;

from the calculated bar positions, ascertaining a number of said bars, which can fit into said viewable area, and displaying said number of bars;

operating a clock in accordance with said tempo;

determining that said clock has reached an end of the displayed number of bars; and changing a displayed part of the rasterised image;

wherein the metadata include co-ordinates in the rasterised image and corresponding timing data for a beginning and an end of respective staves in the musical notation, and a number of bars in the respective staves;

wherein said calculating the position of bars in the musical notation based on the time signature and the tempo involves:

ascertaining a total length of the respective staves in pixels;

ascertaining from the time signature and the number of bars in the respective staves a number of beats in the respective staves and, from the total length of the respective staves and the number of beats in the respective staves, calculating a width in pixels of each of said beats in the respective staves; and ascertaining the bar positions in the respective staves from the widths of said beats.

11. A method according to claim 10, the metadata comprising frequency data for a clock signal.

12. A method according to claim 10, the musical notation comprising one or more musical elements, the metadata comprising a description of a position of each of said one or more musical elements of the musical notation relative to a constant anchor point on the image file.

13. A method according to claim 10, comprising expanding a size of the rasterised image so that a number of pixels in a horizontal or vertical direction of a display screen is smaller than a number of pixels in a horizontal or vertical direction of the expanded rasterised image, and changing the displayed part of the rasterised image in accordance with the size of the expanded rasterised image.

14. An electronic device according to claim 1, wherein the total length of the respective staves in pixels is ascertained taking into account a zoom ratio.

15. A method according to claim 10, wherein the total length of the respective staves in pixels is ascertained taking into account a zoom ratio.

* * * * *